US005224894A

United States Patent [19]

Nelson et al.

[11] Patent Number: 5,224,894

[45] Date of Patent: Jul. 6, 1993

[54] DOLL PLUS INVERTABLE CONTAINER

[75] Inventors: Walter L. Nelson, St. Louis, Mo.; Robert D. Zera, Minnetonka; Gail M. Good, Mound, both of Minn.

[73] Assignee: Tonka Corporation, Minnetonka, Minn.

[21] Appl. No.: 551,528

[22] Filed: Jul. 11, 1990

[51] Int. Cl.[5] ..... A63H 3/00; A63H 33/04

[52] U.S. Cl. ..... 446/73; 446/75; 446/76; 446/77; 446/310

[58] Field of Search ..... 446/74, 72, 321, 385, 446/370, 310, 386, 76, 77, 73, 75

[56] References Cited

U.S. PATENT DOCUMENTS

| | | | |
|---|---|---|---|
| 1,396,766 | 11/1921 | McClelland | 446/321 |
| 1,407,165 | 2/1922 | Pajeau | 446/74 |
| 1,437,467 | 12/1922 | Dykman | 446/74 |
| 1,583,284 | 5/1926 | Dykman | 446/74 |
| 1,640,260 | 8/1927 | Vogel | 446/268 |
| 1,966,986 | 7/1934 | Martin | 446/321 |
| 3,440,747 | 4/1969 | Oliver | 40/126 |
| 3,754,642 | 8/1973 | Stidolph | 206/45.14 |
| 3,791,550 | 2/1974 | Duncan | 220/23.86 |
| 4,319,424 | 3/1982 | Goldfarb et al. | 446/268 |
| 4,795,398 | 1/1989 | Wexler | 446/310 |
| 4,964,831 | 10/1990 | Wolff | 446/75 |

FOREIGN PATENT DOCUMENTS

| | | | |
|---|---|---|---|
| 619702 | 5/1961 | Canada | 446/321 |
| 280867 | 5/1952 | Switzerland | 446/321 |
| 2215226 | 9/1989 | United Kingdom | 446/73 |

*Primary Examiner*—Danton D. DeMille
*Attorney, Agent, or Firm*—Kinney & Lange

[57] ABSTRACT

A container and a container lid enclose and conceal a figurine. The container is made of a resilient shape-retaining polymer material and can be turned inside-out. The container acts as a stand or platform for the figurine when turned inside-out, thereby holding the figurine in an elevated position.

12 Claims, 4 Drawing Sheets

DOLL PLUS INVERTABLE CONTAINER

FIELD OF THE INVENTION

The present invention relates to toys and more particularly to toy dolls resembling human figures.

BACKGROUND OF THE INVENTION

A wide variety of dolls have been known in the past commencing perhaps with figures constructed from grass and twigs to the very modern vehicle/robot figures of the Gobot ® toys of the present day. Toy dolls today are generally constructed of polymeric materials and fabric, sometimes closely resembling the human body, and at other times having a very imaginative appearance.

SUMMARY OF THE PRESENT INVENTION

The present invention includes a toy doll which is constructed of a container and a doll torso mounted in the container. The container may, for example, have a cup-cake shape or a garbage can shape. The container may be in its normal position with the doll torso contained therein. Alternatively, the container portion may be inverted or turned inside out, which supports the doll torso in an elevated position. In the inverted position, the container serves as a skirt for the doll. The container may include a fabric inner liner which resembles a skirt fabric when the container is in the inverted position. The container may also include a polymeric top, e.g. frosting-like, which overlies and conceals the doll when the container is in its normal position. The container may be constructed of a resilient polymer and may be fluted to resemble the conventional cupcake containers which are commercially available. Alternatively, the container may resemble a galvanized garbage can or a redwood garden container.

IN THE DRAWINGS

DETAILED DESCRIPTION OF THE PRESENT INVENTION

Figure 1:
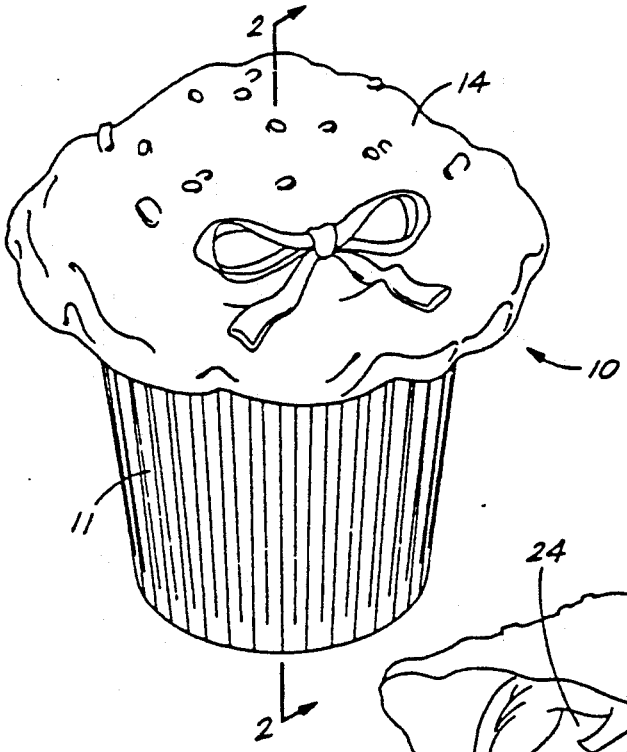
FIG. 1 shows the present invention in the cupcake configuration.
Figure 3:
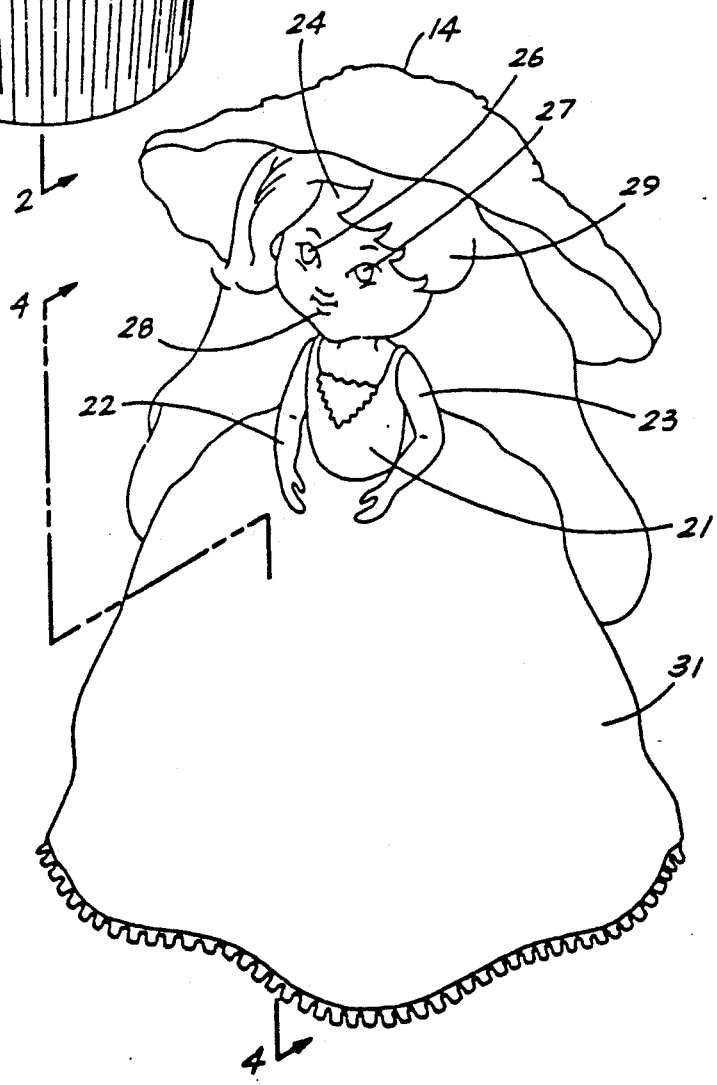
FIG. 3 is a perspective view of the present invention in the doll configuration.
Figure 2:
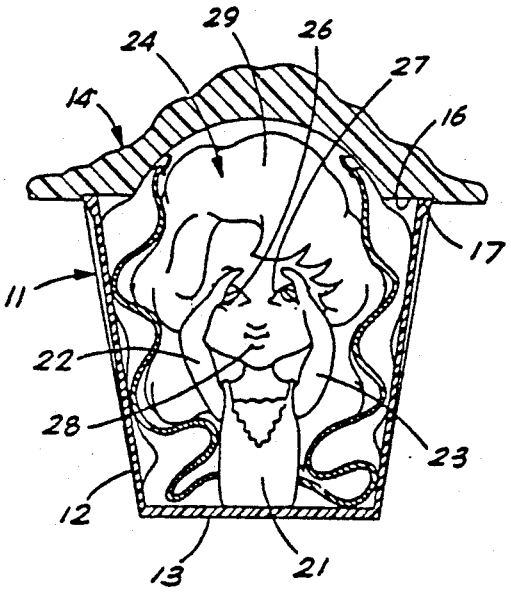
FIG. 2 is a cross-sectional view taken along the line 2—2 in FIG. 1.

The toy 10 of the present invention is illustrated in FIGS. 1 and 2 in the cupcake configuration. The toy 10 includes a container 11 which may be constructed of a resilient polymeric material including a frustoconical wall portion 12 and a bottom wall 13. The frustoconical wall 12 may be fluted to resemble cupcake containers typically used in making cupcakes. The toy 10 may include a top 14 which resembles frosting from a cupcake and/or a hat. The top 14 may include a recess 16 for reception of the rim 17 of the container 11.

The toy 10 includes a doll torso 21 with arms 22,23 and a head 24. The torso 21 may be molded of a suitable polymeric material and may have embossed thereon the appearance of fabric. In other words, the torso 21 may be textured. The arms 22 and 23 may be rotatably mounted in the torso 21 to permit life-like movement of such limbs. Likewise, the head portion 24 may be rotatably mounted in a suitable socket to permit movement of the head during play. The head portion 24 of course includes the typical features of eyes 26,27, lips 28, and hair 29. Desirably, the hair 29 is comprised of long strands or fiber resembling long hair.

A skirt 31 is attached to the torso 21. The skirt 31 may be of any suitable fabric or polymeric sheet material resembling fabric.

Figure 4:
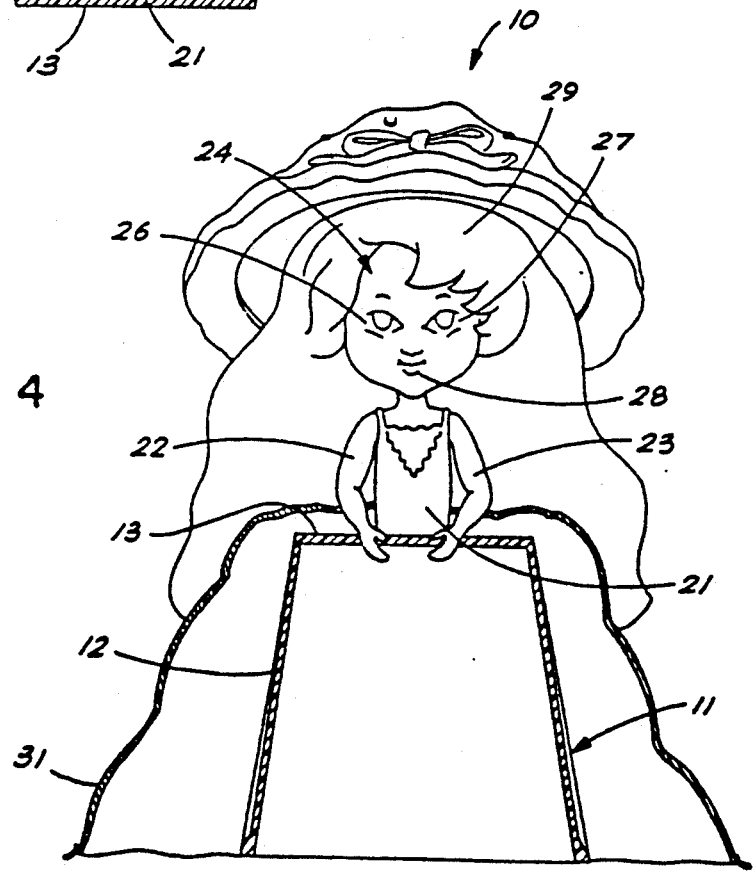
FIG. 4 is a view partially in section along the lines 4—4 in FIG. 3.

The toy 10 may be converted from the cupcake configuration illustrated in FIGS. 1 and 2 by removing the top 14 and turning the container 11 inside out to the position illustrated in FIG. 4 to arrive at the doll configuration. In such a position, the torso 21 is supported in the elevated position with the skirt 31 overlying the container 11. If desired, the top 14 may be superimposed over the head portion 24 to resemble a bonnet. The toy 10 can be converted to the cupcake configuration by reversing the procedure.

ALTERNATIVE EMBODIMENT

Figure 5:
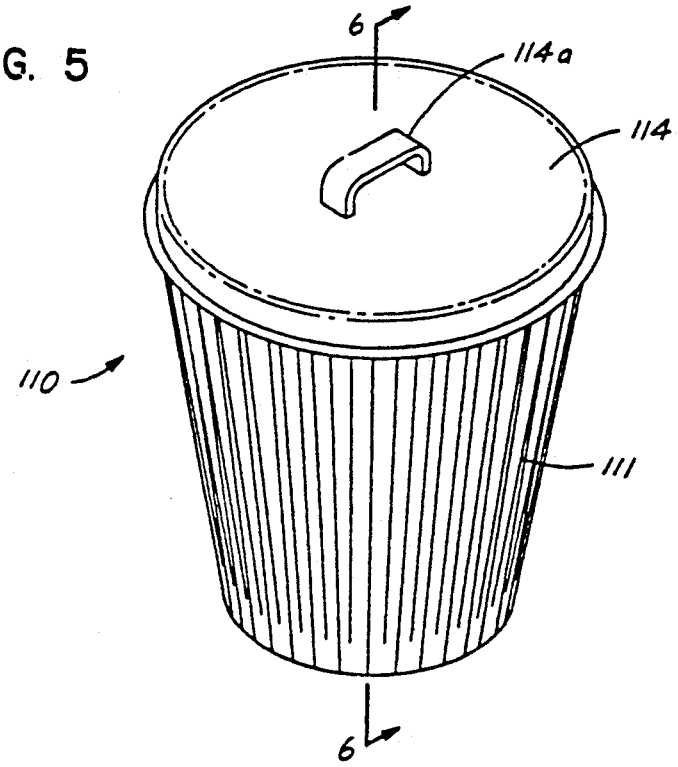
FIGS. 5 and 6 show the present invention in the garbage can configuration.
Figure 6:
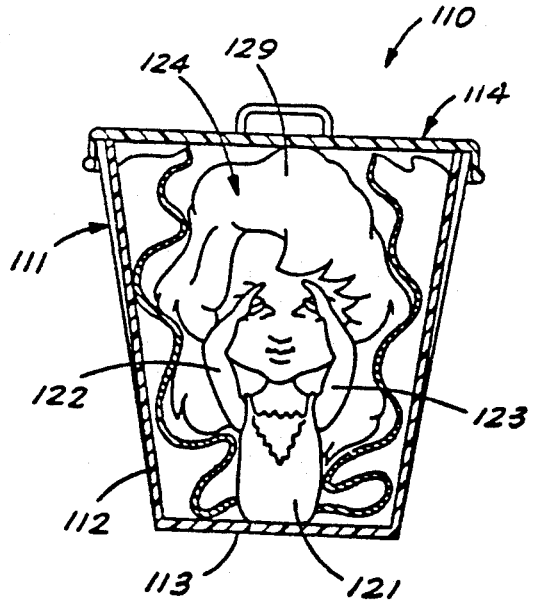

An alternate garbage can doll embodiment 110 of the doll of the present invention is shown in FIGS. 5 and 6. The doll 110 includes a container portion 111 constructed of a shape retaining flexible material, for example, an injection molded polymer. The container portion 111 has a tubular wall portion 112 and an integral bottom wall portion 113. The container portion 111 resembles a galvanized garbage can and may have a top 114 with a handle **114*a***.

The doll 110 has a torso 121 with arms 122,123 and a head 124. The head 124 may have hair depicted thereon. The toy doll 110 may be converted from the enclosed container configuration to the exposed doll configuration in a manner very similar to that described with respect to the cup-cake doll and shown in FIG. 4.

SECOND ALTERNATE EMBODIMENT

Figure 7:
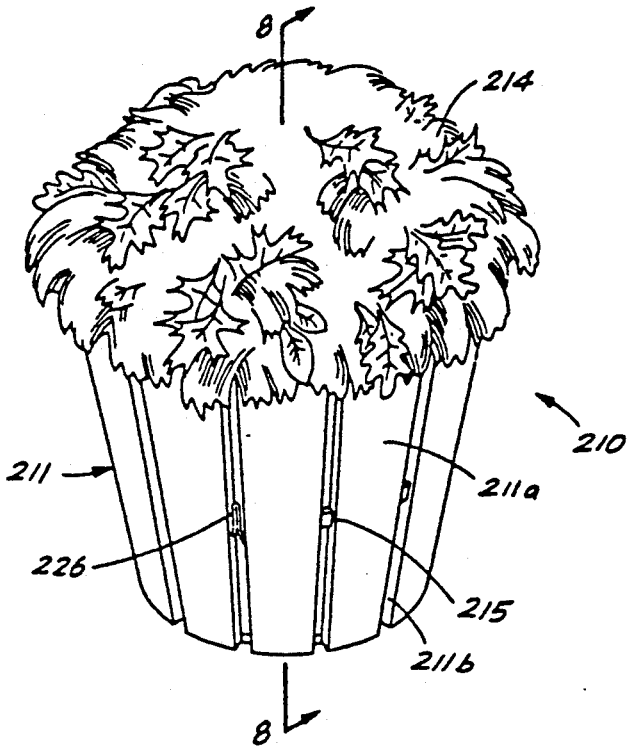
FIGS. 7 and 8 show the present invention in the redwood basket configuration.
Figure 8:
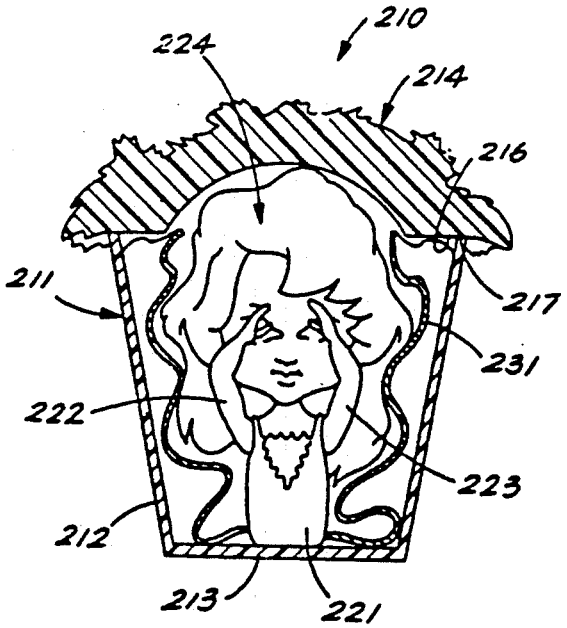

A second alternate embodiment 210 of the present invention is shown in FIGS. 7 and 8. In this instance the container portion 211 resembles a redwood garden basket with a plurality of slats **211*a* and open spaces 211*b* therebetween. The container 211 has a bottom wall portion 213. If desired, the slats 211*a* may be reinforced at the outer ends such as with elastic bands 215 or a wishbone shaped spring 226 that are secured to the slats 211*a*. The container 211 may be enclosed with a cover 214** resembling tree leafs and grass.

The doll 210 likewise has a torso 221, arms 222,223 and a head 224. The doll 210 may be have a skirt 231 attached to the torso 221. The inner side of the skirt may resemble a black or green leaf bag which can be viewed through the open spaces **211*b*. The doll 210 may be converted from container to doll configurations as described with respect to the cup-cake doll 10. The slats 211*a* may have a memory with respect to the bottom wall portion 213** such that appropriate container positions or torso supporting positions will be maintained as desired.

While preferred embodiments of the present invention have been disclosed, it is to be recognized that various modifications may be made without departing from the broader scope of the present invention. For example, the container 11 may be embossed with surface texture to resemble fabric in lieu of the loosely hanging fabric material 31. The container may be any of various other depictions such as an ice cream cone, Coca Cola® glass or a flower e.g. tulip or daisy. The doll figure may be other than a human figure, e.g. a pet dog figure.

What is claimed is:

1. A toy doll comprising a resilient base having a frustoconical portion and an integral end portion extending transverse to a longitudinal axis of said frustoconical portion, a doll torso mounted on said end portion, said base being adapted to be turned inside out, whereby said base serves as a container for said doll torso when in the inside in position and as a frustoconical-shaped support base when in the inside out position and wherein said doll includes a cover that serves to enclose said base while said base is serving as a container.

2. The toy doll of claim 1 wherein said cover is adapted to serve as a hat when in the torso elevated base position.

3. The toy doll of claim 1 wherein said frustoconical portion resembles a garbage can.

4. The toy doll of claim 1 wherein said frustoconical portion comprises a plurality of slats resembling a redwood garden basket.

5. The toy doll comprising a container, a cover for the container and a doll torso, said cover being disposed on said container when said torso is disposed within said container, said cover being removable relative to said container and to said doll torso to allow said container to be turned inside out thereby displaying said torso, and said inverted container serving as a support for said torso.

6. The toy doll of claim 5 wherein said container is fluted to resemble a cupcake container.

7. The toy doll of claim 5 wherein said cover resembles frosting on a cup-cake.

8. The toy doll of claim 6 wherein said cover resembles frosting on a cup-cake.

9. The toy doll of claim 5, wherein said container is fluted to resemble a cup-cake container.

10. The toy doll comprising a cup-cake shaped container, a cover for said container, a doll torso and a skirt, said cover being disposed on said container when said torso and skirt are disposed within said container, said cover being removable relative to said container and to said doll torso, said container being comprised of a resilient polymer and fluted to resemble a cupcake container, said container being adapted to be turned inside out thereby forming a support for displaying said torso, and said inverted container serving as a support for said skirt.

11. The toy doll of claim 10 wherein said cover is formed of a polymer such that said cover resembles frosting on a cup-cake.

12. The toy doll of claim 11 wherein said cover simulates a hat when said toy is in the doll configuration and simulates frosting when in the cup-cake configuration.

* * * * *